US005425190A

United States Patent [19]

Jensen

[11] Patent Number: 5,425,190

[45] **Date of Patent: * Jun. 20, 1995**

[54] FEEDING APPARATUS INCLUDING INSERTION DEVICES FOR FEEDING FLATWORK TO AN IRONER

[75] Inventor: Jørn M. Jensen, Bern, Switzerland

[73] Assignee: Ejnar Jensen & Sons A/S, Ronne, Denmark

[ * ] Notice: The portion of the term of this patent subsequent to May 23, 2012 has been disclaimed.

[21] Appl. No.: 12,150

[22] Filed: Jan. 27, 1993

[30] Foreign Application Priority Data

Jan. 29, 1992 [DK] Denmark ..... 106/92

[51] Int. Cl.[6] ..... D06F 67/04

[52] U.S. Cl. ..... 38/143

[58] Field of Search ..... 38/1 R, 1 A, 8, 11, 38/12, 143, 144; 414/13

[56] References Cited

U.S. PATENT DOCUMENTS

| | | | |
|---|---|---|---|
| 3,468,532 | 9/1969 | Valentine | 38/143 X |
| 3,552,743 | 1/1971 | Baboz | 38/12 |
| 3,604,132 | 9/1971 | Thompson | 38/143 |
| 3,729,846 | 5/1973 | Weir | 38/143 |
| 3,911,604 | 10/1975 | Stostrom | 38/143 |
| 4,299,521 | 11/1981 | Jensen | 38/12 X |
| 4,378,645 | 4/1983 | Allen et al. | 38/8 |
| 4,885,853 | 12/1989 | McCabe | 38/143 |

FOREIGN PATENT DOCUMENTS

| | | | |
|---|---|---|---|
| 0668556 | 9/1964 | Belgium | 38/143 |
| 523872 | 1/1993 | European Pat. Off. . | |
| 2283979 | 9/1975 | France . | |
| 0238409 | 2/1986 | Germany | 38/1 R |
| 1062199 | 3/1990 | Japan | 38/143 |
| 2221226 | 1/1990 | United Kingdom | 38/143 |

*Primary Examiner*—Clifford D. Crowder
*Assistant Examiner*—Ismael Izaguirre
*Attorney, Agent, or Firm*—Kerkam, Stowell, Kondracki & Clarke; Harold L. Stowell

[57] ABSTRACT

An apparatus for feeding flatwork to a laundry processing unit, for instance an ironing roller. The apparatus includes a conveyor belt at its front end and a spreading arrangement including a rail having a pair of carriages movable transversely to a longitudinal direction of the apparatus. The apparatus includes operator-activated insertion devices placed on the side of the rail opposite the belt. The carriages include drives for moving the carriages away from each other and clamps positioned symmetrically with respect to a middle of the belt. The insertion devices include elevators in which the article is inserted in a pair or clamps on a slide, movable along the rail. The flatwork articles are transferred from the spreading arrangement to the ironer by inserting the corners in the elevator clamps and transferring these to the carriage clamps which spread the flatwork and transfer this to the belt and into the ironer.

8 Claims, 2 Drawing Sheets

FEEDING APPARATUS INCLUDING INSERTION DEVICES FOR FEEDING FLATWORK TO AN IRONER

Related subject matter is disclosed and claimed in application Ser. No. 08/008,781, filed Jan. 27, 1993.

FIELD OF THE INVENTION

The present invention relates to an apparatus for feeding flatwork articles to a laundry processing unit, for example an ironing roller. The apparatus may include a conveyor belt, at the front end of which flatwork articles can be transferred from a spreading arrangement comprising a rail means with a pair of carriages running transversely to the longitudinal direction of the conveyor belt, each carriage being provided with a releasable clamp, into which a corner of a flatwork article can be inserted by means of a number of operator-activated insertion devices placed on the side of the rail means opposite to the conveyor belt, said pair of carriages being provided with drive means adapted to move the carriages in the pair of carriages away from each other from a point preferably opposite to the middle of the front end of the conveyor belt to an extended position, in which the clamps are positioned symmetrically with respect to the middle of the conveyor belt, and in which the upper edge of the flatwork article is spread out, means being provided for transferring the upper end of the flatwork article to the front end of the conveyor belt.

BACKGROUND OF THE INVENTION

In apparatuses of this kind it has been common practice that the clamps, in which the operators should insert the flatwork article, have been positioned fairly high, for instance in level with the face of the operator. This positioning was of course a natural consequence of the fact that the flatwork article, while it is being spread in front of the front edge of the conveyor belt, should hang down freely in order to avoid folds, when the flatwork article is transferred to the conveyor belt, the rail means, along which the carriages move, extending horizontally in front of the conveyor belt. An apparatus is known, in which the flatwork articles are not directly inserted in the clamps holding the flatwork article while it is being spread, but in which the flatwork article is inserted in insertion devices, which after the insertion of the flatwork article transfer it to the clamps on the two carriages. An apparatus of this kind is known from a U.S. Patent assigned to McGraw-Edison. After the transfer to the carriages on the transverse rail means the two carriages are moved symmetrically away from each other for stretching the leading edge of the flatwork article. The rail means is displaceable in the direction of the conveyor belt, and this displacement is used for taking the leading edge of the flatwork article over the front end of the conveyor.

The insertion devices in this known apparatus are designed as clamp panels, which are displaceable or swingable in a horizontal plane and which are provided with two fork-shaped clamps, in which the operator places the flatwork piece. In front of the aparatus there may be three operation stations, the middle one of which displacing the clamp panel along the centre line of the apparatus, and the two ones, which are placed on each side of the central panel, perform a swinging movement towards the centre. As the flatwork articles must hang down freely while being transferred to the clamps on the two carriages, the operators have to lift the flatwork articles approx. to face level, which makes the work of insertion strenous and which also puts a heavy strain on the arms and shoulders of the operator.

SUMMARY OF THE INVENTION

The object of the invention is to provide an apparatus of the kind mentioned by way of introduction, in which there is a possibility of designing the operating stations in such a way that the flatwork article can be inserted without being lifted to the height, at which it is to be transfered to the conveyor belt, but where the possibility of letting the flatwork article hang down freely during the spreading still exists.

This object is met according to the invention bvy designing the apparatus as stated in the characterizing clause of claim 1.

In this embodiment of the apparatus, the operator does not have to lift the flatwork article to the level, at which the spreading is to take place, as this job is done by the obliquely upwards running elevator means. The work of the operators is therefore facilitated to a considerable degree. At the same time there is no need, when constructing the apparatus, to take into consideration how high the operators should lift the flatwork articles, but the transverse rail means can according to need be placed so high, that even the biggest flatwork articles can hang down freely during the spreading. As a consequence of the reduction in the operator's physical work, a quicker insertion rate can be attained, whereby the effectiveness of the functions of the apparatus will be exploitable in practice.

According to the invention an improved function of the apparatus is attained thereby that the insertion device comprises a number of elevator means placed next to each other, which bring the flatwork articles up towards the pair of carriages, the pair of carriages with respect to at least some of the elevator means being adapted to meet the flatwork article in a postion opposite to the elevator means and deviating from the centre of the conveyor belt. By not taking the elevator means towards a joint, central point, the risk of collision between the slides is eliminated in the area, in which the transfer from the clamps of the slides to the clamps of the carriages is to take place. This advantage is admittedly achieved at the expense of a more complicated controlling of the carriage movement, but it has turned out in practice that the controlling task may be carried out by means of computer technology.

It is preferred out of consideration to the smoothing of the flatwork article during the spreading process to adapt the pair of carriages to move in close relationship towards the centre of teh rail means, before the carriages for spreading the flatwork article are moved apart. By this arrangement the advantages of the known, spreading ribbons placed in pairs for smoothing the down-hanging part of the flatwork article can be exploited, while it is being conveyed on the conveyor belt.

According to the preferred embodiment, the number of elevator means is three, and they are placed essentially parallelly and symmetrically in relation to the rail means.

On account of the position of the elevator means in front of the inlet end of the conveyor belt it is not immediately possible to place means for transferring the flatwork article on the side opposite to the conveyor belt.

For this reason and according to a preferred embodiment of the invention the means for transferrring the flatwork article to the conveyor belt designed in such a way that the front end of the conveyor belt is placed behind the rail means and closely below the rail means, the conveyor belt comprising a movable front end, which from a starting position is movable in a direction towards the spread out flatwork article and which in an advanced position is connected with a vaccum source discharging below the upper lane of the conveyor belt.

According to the invention the transverse rail means is placed at such a height that the spread flatwork articles can hang down essentially freeely from the clamps of the carriages.

Out of consideration for the operators it is preferred that the elevator means has such a length that the operating position of the operator can be determined by ergonomic considerations. The obliquely upwards running elevator means make and adaptation to the individual operators immediately possible by a displacement of the lower end stop. In that way both tall and less tall operators can obtain a working position, which under the conditions given must be considered comfortable, and where the major part of the lifting job during the insertion is eliminated.

According to a preferred embodiment the slide carrying the pair of clamps is placed on the bottom side of the rail means in the elevator means, the rail means carrying the slide forming a screen, which prevents injury of the operator on account of the movement of the slide.

In order to prevent the operator from getting his hands close to the movable slide during its movement, a release button is according to the invention placed on the top side of the rail means for activating the transfer to the carriages on the transverse rail means.

BRIEF DESCRIPTION OF THE DRAWINGS

The invention will be described in detail in the following with reference to the accompanying drawing, in which.

DETAILED DESCRIPTION OF THE PREFERRED EMBODIMENTS

Figure 1:
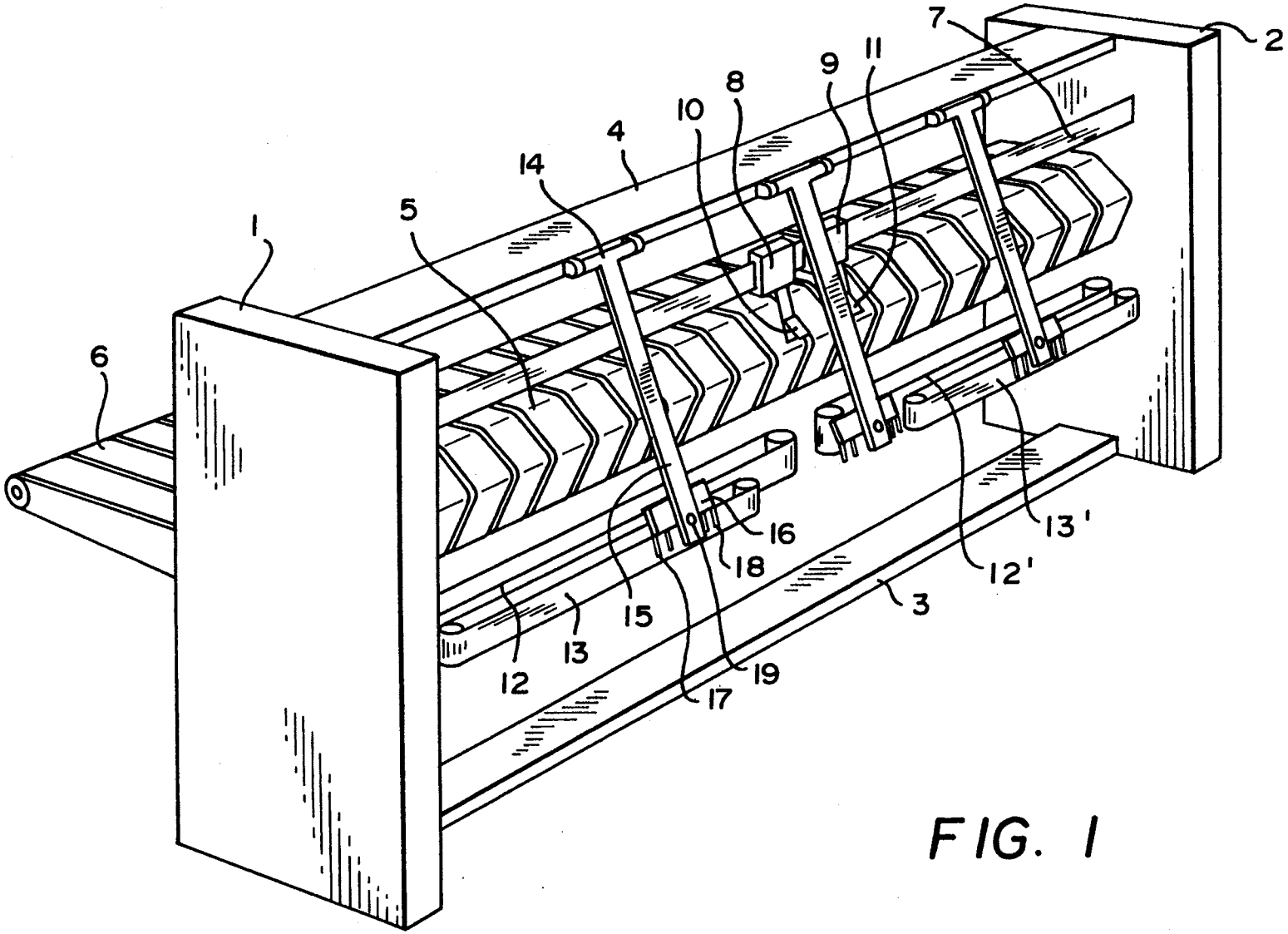
FIG. 1 is an oblique view of an apparatus accordlong to the invention in a simplified form.

The apparatus shown in FIG. 1 for feeding flatwork articles to a laundry processing apparatus, for instance an ironing roller, comprises a frame building a kind of portal with two gables 1 and 2 connected by means of transverse members 3 and 4. The frame thus forms an opening giving room for a conveyor belt 5 conveying flatwork articles, which are spead out and introduced at the front side of the apparatus towards the processing apparatus, which receives the spread out flatwork articles at the end 6 of the conveyor belt. For spreading the flatwork article the apparatus comprises a spreading arrangement, the major components of which are a rail means 7, extending between the two gables 1,2, and two carriages 8 and 9 running thereon. Each of the carriages is provided with a releasable clamp 10 and 11, adapted to hold a corner of a flatwork article, which is to be spread, and, when the carriages have moved apart, to spread out the leading edge of the flatwork article for releasing the flatwork article, which then, by means of the means described below is transferred to the conveyor belt 5. What is transferred to the conveyor belt is the leading edge of the flatwork article, while the rest of the flatwork article is hanging down freely, until by and by it is pulled up on the conveyor belt and conveyed towards the end in flat, spread out condition. To smooth folds, if any, in the down-hanging flatwork articles simultaneously with the carriages being taken apart, it is with the side edges introduced between two pairs of spreading ribbons 12,13 and 12',13'. The pairs of spreading ribbons are driven in the opposite direction in such a way that the ribbon sections facing one another run in the same direction and away from the centre of the apparatus.

It is an important detail in the apparatus that the rail means 7 is placed up high, thereby making it possible for the flatwork article to hang down freely during the spreading operation, which partly enhances the effect of the spreading ribbons 12,13, partly makes it possible to let the conveyor belt consist of two parts, a lower part (not shown), which goes all the way through to the delivery end and has a front end, on which flatwork articles may be placed directly manually, which is often advantageous in case of smaller flatwork articles, the biggest dimension of which does not exceed what can be reached by an operator, while flatwork articles, which are spread by means of the carriages 8,9 are delivered to an upper conveyor belt, which is shorter and the end of which is placed above the lower, through-going conveyor belt. The high positioning of the rail means and the clamps 10,11 prevents operators from directly placing the flatwork article in the clamps 10,11, which would also limit the capacity of the apparatus to what a single operator could perform, and the apparatus is therefore equipped with a number of insertion devices 14. The number will normally be three, but two or four of these devices may also be used. The insertion devices comprise an obliquely upwards extending elevator means 15, on the under side of which a sledge 17 with a downwards facing pair of clamps 17,18 is placed. The operator places a flatwork article in this pair of clamps with one corner in each and then gives a ready-signal on a suitably conveniently placed release button 19. The ready-signal releases an insertion function, controlled by a PLC. Before the flatwork article placed in the clamps can be transferred to the clamps 10,11, the carriages are to be brought into position opposite the insertion device 14 in question. The drive means for the carriages 8,9 therefore comprises means, which are partly able to move the carriages from a random starting position so that they meet opposite one of the three insertion stations 14, where a ready-signal has been given, partly are able to move the carriages together towards the middle of the rail means 7, and partly finally are able to move the carriages symmetrically apart opposite the middle of the rail means. When the carriages are positioned in front of an insertion station, the sledge is moved upwards and the corners of the flatwork articles are caught, the pair of clamps 17,18 passing the clamps 10,11. The sledge is immediately taken back, and the carriages 8,9 are moved to the middle and then symmetrically apart.

The drive means of the carriages may consist of two separate drive engines, which are each via a wire loop driving one of the two carriages. The motors are equipped with a decoder giving signals to the PLC about the positioning of the carriages. The two motors are besides placed with their shafts end to end and with a releasable coupling between the two shafts. By activation of the coupling the two carriages can be moved symmetrically from the position, the carriages had before the activation of the coupling. The arrangement also makes it possible to use powerful eninges, which permit a quick acceleration of the carriages, when this is desired, and a halving of the effect by only supplying one motor with current, when the two shafts are coupled together. The last possibility is most applicable when spreading the edge of the flatwork article, a straining of the edge of the flatwork article being thus avoided.

Figure 2:
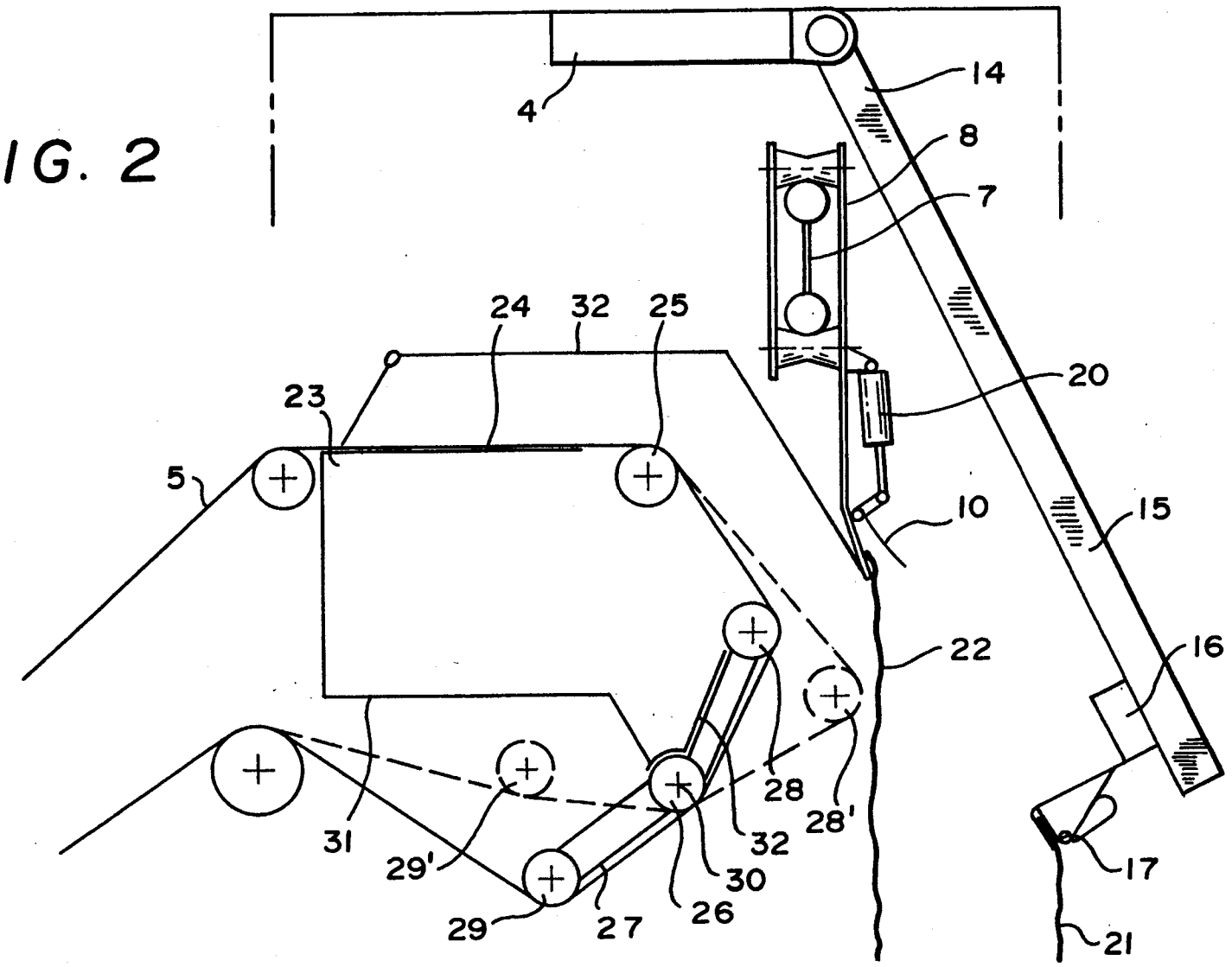
FIG. 2 is a partial sectional view through the apparatus illustrating the means used for the transfer of the spread flatwork article to the conveyor belt.

FIG. 2 is a sectional view of the arrangement for transferring the flatwork article spread out by means of the carriages 8,9. As the place in front of the rail means is taken up by the insertion devices 14, there is no possibility of introducing a bar or another instrument from the front side under the clamps 10,11, thereby brushing the leading edge of the flatwork article on to the conveyor belt 5. With a view to the fact that the next spreading operation is to be started before the trailing edge of the preceding flatwork article has pased the front end of the conveyor belt, the front end of the conveyor belt should be positioned somewhat behind the path of the clamps 10,11 during the spreading operation. These requirements are met by the arrangement shown in a sectional view in FIG. 2. The figure shows the rail means 7 and a carriage 8 running thereon. A clamp 10 is mounted on the carriage 8, said clamp being activated by means of a pneumatic cylinder 20. In front of the rail means and the carriage one of the insertion devices 14 having a slide 16 and a clamp 17 can be seen. In the clamp 17 a flatwork article 22 is inserted, which by upwards displacement of the slide along the rail means 15 of the insertion device is moved upwards and caught by the clamp 10, which is simultaneously activated by means of the cylinder 20. The slide is moved so much past the clamp 10 that the flatwork article 21 is pulled out of the clamp 17, and after the closing of the clamp 10, sufficient room is also given for the slide to move back past the clamp 10. The flatwork article will then be transferred to the position shown by 22. This position is, as will be seen from the figure, in front of and a short distance from the conveyor belt 5. The arrangement will be described in detail in the following.

The conveyor belt 5 is carried by a number of rollers thus enclosing a room, in which a suction box 23 is placed. The suction box has an upper, essentially horizontal wall 24, at the front edge of which a foremost, upper roller 25 is provided. Below the roller 25 is placed a rocking arrangement 26 comprising a two-armed lever 27, at the end of which rollers 28,29 are placed. The lever 26 is journalled around a rocking axis 30. The suction box has a rear wall and a bottom wall 31 extending to and being in close relationship with the rocking arrangement 26 at the axis 30. Between the wall 31 and the roller 28 a screen 32 is placed. The suction box is thus essentially air-tight except for the area between the upper, foremost roller 25 and the roller 28. The conveyor belt 5 consists either of a perforated lane or a row of comparatively narrow straps placed next to each other. A flatwork article placed on the belt section between the rollers 25 and 28 will therefore be firmly sucked against the belt section, and the friction attained thereby will be sufficient to prevent the flatwork article from sliding, even though the major part of its length hangs freely down from the roller 28. As the roller 28 is positioned somewhat behind the clamps 10, a flatwork article, which is sucked to the belt section between the rollers 25 and 28, will be conveyed on the conveyor belt 5 and transported towards the end 6 (FIG. 1) of the conveyor belt simultaneously with the perpendicular movement on the plane of the figure of the carriage 8 and the clamp 10 in front of the roller 28.

When transferring a flatwork article from the clamps 10 and 11 to the conveyor belt 5, the rocking arrangement is moved from the fully lined position to the position shown with dotted lines, in which the foremost roller is positioned at 28' and gets in contact with a flatwork article suspended in the clamp 20. Simultaneously with the forward movement of the roller 28, the suction box is opened more, the air flow in the area between the screen and the roller 28' increasing, which expedites the transfer of the leading edge of the flatwork article on the conveyor belt. As soon as the flatwork article gets in contact with the conveyor belt it is sucked thereto and conveyed on the conveyor belt 5. The conveyor belt moves upwards thereby making its grip of the flatwork article more firm, said grip being at its maximum, as soon as the leading edge has reached the roller 25, at which time the rocking arrangement 26 can move back to the fully lined position.

It is possible to reduce the requirements to the vacuum, which must exist in the suction box 23, by covering the front part of the conveyor belt by a screen 32. The screen has at its back a flap allowing passage of the flatwork article on the conveyor belt, and is at the front extending to the bottom part of the clamp 10. The screen 32 serves a double purpose, viz. firstly to concentrate the air flow to the area around the leading edge of the flatwork article, when it is extended between the clamp 10 and the clamp 11 on the second carriage 9, and secondly to form a ruler keeping the leading edge of the flatwork article straight during the spreading. The screen contributes to making the transfer of the flatwork article quick and to attaining an essentially straight leading edge of the flatwork article, when conveyed on the conveyor belt. This is important for the further treatment of the flatwork article in the subsequent processing step, for instance in an ironing roller or a folding machine.

By using a rocking arrangement with two rollers 28 and 29, it will be possible to maintain an essentially constant tightening of the belt by simple means. The constant tightening of the belt may, however, also be obtained in another way, for instance by means of a spring-loaded roller, and correspondingly the movement of the roller 29 may take place in another way than by swinging. The swinging movement is in particular advantageous, while the covering of the suction box may be effected by simple means.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as described herein and in the following claims.

I claim:

1. An apparatus for feeding flatwork articles to an ironing roller, said apparatus comprising a conveyor belt having a front end, middle and rear end, at the front end of the conveyor belt flatwork articles are transferred from a spreading arrangement comprising a rail means with a pair of carriages running transversely to the longitudinal direction of the conveyor belt, each carriage being provided with a releasable clamp, into which a corner of a flatwork article is inserted by insertion devices placed on the side of the rail means opposite to the conveyor belt, said pair of carriages provided with drive means to move the carriages away from each other from the middle of the conveyor belt to an extended outward position, in which the clamps are positioned symmetrically with respect to the middle of the conveyor belt, and in which the flatwork article is spread out, means provided for transferring the upper end of the flatwork article to the front end of the conveyor belt, wherein operator-controlled insertion devices (14) comprise elevator means adapted, from an operating position, in which the flatwork article is inserted in a pair of gripping means (17, 18) on a slide (16) movable along a guide means (15), to move the flatwork article upwards against the pair of carriages (8, 9) placed essentially higher than the operating position.

2. Apparatus according to claim 1, wherein the insertion devices (14) comprise a plurality of elevator means (15) placed next to one another, said elevator means taking the flatwork articles towards the pair of carriages (8, 9), wherein the pair of carriages are constructed and arranged to meet the flatwork article in a position, said position being an off-center position with respect to when the elevator means from a center position.

3. Apparatus according to claim 2, wherein the pair of carriages (8, 9) are adapted to move in close relationship towards the center of the rail means (7) to spread the flatwork articles apart from each other.

4. Apparatus according to claim 1, wherein the number of elevator means (15) is three, the elevator means being positioned substantially in parallel and symmetrically in relation to the rail means (7) carrying the two carriages (8, 9).

5. Apparatus according to claim 1, wherein the front end of the conveyor belt (5) is placed behind the rail means (7) and closely below the rail means, the conveyor belt comprising a movable front end, which from a starting position is movable in a direction towards the spread-out flatwork article (22) and which, in an advanced position, is connected with a vacuum source (23).

6. Apparatus according to claim 1, wherein the rail means (7) is placed at a height wherein the spread-out flatwork articles (22) hang down essentially freely from the clamps (10, 11) on the carriages (8, 9).

7. Apparatus according to claim 1, wherein the slide (16) with the pair of gripping means (17, 18) is placed on a bottom side of the rails means in the elevator means.

8. Apparatus according to claim 7, further comprising a release button (19) placed on a top side of the rail means (15) of the elevator means for activating the transfer of the carriages (8, 9) on the transverse rail means (7).

* * * * *

UNITED STATES PATENT AND TRADEMARK OFFICE

CERTIFICATE OF CORRECTION

PATENT NO. : 5,425,190

DATED : June 20, 1995

INVENTOR(S) : Jørn M. JENSEN

It is certified that error appears in the above-identified patent and that said Letters Patent is hereby corrected as shown below:

On the title page under "[73] Assignee:" "Ejnar Jensen & Sons A/S" should read -- Ejnar Jensen & Son A/S --

In column 7, line 27 [claim 2, line 8]: after "means" insert -- deviate. --

Signed and Sealed this

Twenty-second Day of August, 1995

*Attest:*

Bruce Lehman

BRUCE LEHMAN

*Attesting Officer*

*Commissioner of Patents and Trademarks*